US008731909B2

(12) United States Patent
Yamanashi et al.

(10) Patent No.: US 8,731,909 B2
(45) Date of Patent: May 20, 2014

(54) SPECTRAL SMOOTHING DEVICE, ENCODING DEVICE, DECODING DEVICE, COMMUNICATION TERMINAL DEVICE, BASE STATION DEVICE, AND SPECTRAL SMOOTHING METHOD

(75) Inventors: Tomofumi Yamanashi, Kanagawa (JP); Masahiro Oshikiri, Kanagawa (JP); Toshiyuki Morii, Kanagawa (JP); Hiroyuki Ehara, Kanagawa (JP)

(73) Assignee: Panasonic Corporation, Osaka (JP)

( * ) Notice: Subject to any disclaimer, the term of this patent is extended or adjusted under 35 U.S.C. 154(b) by 694 days.

(21) Appl. No.: 13/057,454

(22) PCT Filed: Aug. 7, 2009

(86) PCT No.: PCT/JP2009/003799

§ 371 (c)(1),
(2), (4) Date: Feb. 3, 2011

(87) PCT Pub. No.: WO2010/016271

PCT Pub. Date: Feb. 11, 2010

(65) Prior Publication Data

US 2011/0137643 A1 Jun. 9, 2011

(30) Foreign Application Priority Data

Aug. 8, 2008 (JP) ..... 2008-205645
Apr. 10, 2009 (JP) ..... 2009-096222

(51) Int. Cl.
*G10L 19/02* (2013.01)
*G10L 19/14* (2006.01)
*G10L 19/00* (2013.01)

(52) U.S. Cl.
USPC ..... 704/203; 704/205; 704/500

(58) Field of Classification Search
USPC ..... 704/200–230, 500–504
See application file for complete search history.

(56) References Cited

U.S. PATENT DOCUMENTS 5,303,346 A * 4/1994 Fesseler et al. ..... 704/230
5,495,552 A * 2/1996 Sugiyama et al. ..... 704/201

(Continued)

FOREIGN PATENT DOCUMENTS

JP 5-22151 1/1993
JP 2000-259190 9/2000

(Continued)

OTHER PUBLICATIONS

International Search Report dated Nov. 2, 2009.

(Continued)

*Primary Examiner* — Samuel G Neway
(74) *Attorney, Agent, or Firm* — Dickinson Wright PLLC

(57) ABSTRACT

Disclosed is a spectral smoothing device with a structure whereby smoothing is performed after a nonlinear conversion has been performed for a spectrum calculated from an audio signal, and with which the amount of processing calculation is significantly reduced while maintaining excellent audio quality. With this spectral smoothing device, a sub band division unit (102) divides an input spectrum into multiple sub bands; a representative value calculation unit (103) calculates a representative value for each sub band using an arithmetic mean and a geometric mean; with respect to each representative value, a nonlinear conversion unit (104) performs a nonlinear conversion the characteristic of which is further emphasized as the value increases; and a smoothing unit (105) that smoothes the representative value which has undergone the nonlinear conversion for each sub band, at the frequency domain.

12 Claims, 12 Drawing Sheets

(56) References Cited

U.S. PATENT DOCUMENTS

| | | | | |
|---|---|---|---|---|
| 2002/0049584 | A1 | 4/2002 | Bruhn | |
| 2003/0233236 | A1* | 12/2003 | Davidson et al. | 704/258 |
| 2004/0013276 | A1 | 1/2004 | Ellis | |
| 2004/0153314 | A1* | 8/2004 | Sato | 704/207 |
| 2006/0004566 | A1 | 1/2006 | Oh et al. | |
| 2007/0136053 | A1 | 6/2007 | Ebenezer | |
| 2008/0027733 | A1* | 1/2008 | Oshikiri et al. | 704/500 |
| 2009/0157413 | A1 | 6/2009 | Oshikiri | |

FOREIGN PATENT DOCUMENTS

| | | | |
|---|---|---|---|
| JP | 2002-244695 | | 8/2002 |
| JP | 2002244695 | A * | 8/2002 |
| JP | 2003-216190 | | 7/2003 |
| JP | 2006-011456 | | 1/2006 |
| WO | 2007/037361 | | 4/2007 |

OTHER PUBLICATIONS

Y. Takamizawa, et al., "High-Quality and Processor-Efficient Implementation of an MPEG-2 ACC Encoder," IEICE Trans. Inf. & Syst., vol. E86-D, No. 3, Mar. 2003, pp. 418-424.

European Search Report dated Jul. 24, 2012.

M. Oshikiri, "An 8-32 kbit/s Scalable Wideband Coder Extended with MDCT-based Bandwidth Extension on top of a 6.8 kbit/s Narrowband CELP Coder," 8$^{th}$ Annual Conference of the International Speech Communication Association, vol. 1, XP009161109, Aug. 27-31, 2007, pp. 465-468.

"Draft new Recommendation ITU-T G.718 Amendment 2 (ex G.718-SWB) Frame error robust narrowband and wideband embedded variable bit-rate coding of speech and audio from 8-32 kbit/s: New Annex B on superwideband scalable extension for G.718 and corrections to main body fixed-point C-code and description text," ITU-T Drafts, Study Period 2009-2012, International Telecommunication Union, XP017450632, Nov. 4, 2009, 57 pages total.

* cited by examiner

SPECTRAL SMOOTHING DEVICE, ENCODING DEVICE, DECODING DEVICE, COMMUNICATION TERMINAL DEVICE, BASE STATION DEVICE, AND SPECTRAL SMOOTHING METHOD

TECHNICAL FIELD

The present invention relates to a spectrum smoothing apparatus, a coding apparatus, a decoding apparatus, a communication terminal apparatus, a base station apparatus and a spectrum smoothing method smoothing spectrum of speech signals.

BACKGROUND ART

When speech/audio signals are transmitted in a packet communication system typified by Internet communication and a mobile communication system, a compression/coding technique is often used to improve the transmission rate of speech/audio signals. Furthermore, in recent years, in addition to a demand for simply encoding speech/audio signals at low bit rates, there is an increasing demand for a technique to encode speech/audio signals in high quality.

To meet this demand, studies are underway to develop various techniques to perform orthogonal transformation (i.e. time-frequency transformation) of a speech signal to extract frequency components (i.e. spectrum) of the speech signal and apply various processing such as linear transformation and non-linear transformation to the calculated spectrum to improve the quality of the decoded signal (see, for example, patent literature 1). According to the method disclosed in patent literature 1, first, a frequency spectrum contained in a speech signal of a certain time length is analyzed, and then non-linear transformation processing to emphasize greater spectrum power values is applied to the analyzed spectrum. Next, linear smoothing processing for the spectrum subjected to non-linear transformation processing, is performed in the frequency domain. After this, inverse non-linear transformation processing is performed to cancel non-linear transformation characteristics, and, furthermore, inverse smoothing processing is performed to cancel smoothing characteristics, so that noise components included in the speech signal over the entire band are suppressed. Thus, with the method disclosed in patent literature 1, all samples of a spectrum acquired from a speech signal are subjected to non-linear transformation processing and then the spectrum is smoothed, so that the speech signal is acquired in good quality. Patent literature 1 introduces transformation methods such as power transform and logarithmic transform as examples of non-linear processing.

CITATION LIST

Patent Literature

PTL 1
Japanese Patent Application Laid-Open No. 2002-244695
PTL 2
WO 2007/037361

Non-Patent Literature

NPL 1
Yuichiro TAKAMIZAWA, Toshiyuki NOMURA and Masao IKEKAWA, "High-Quality and Processor-Efficient Implementation of and MPEG-2 AAC Encoder", IEICE TRANS. INF. & SYST., VOL. E86-D, No. 3 MARCH 2003

SUMMARY OF INVENTION

Technical Problem

However, with the method disclosed in patent literature 1, non-linear transformation processing needs to be performed for all samples of a spectrum acquired from a speech signal, and therefore there is a problem that the amount of calculation processing is enormous. Furthermore, if only part of samples of a spectrum are extracted to reduce the amount of calculation processing, sufficiently high speech quality cannot be always achieved by simply performing spectrum smoothing after non-linear transformation.

Based upon a configuration for performing non-linear transformation of a spectrum value calculated from a speech signal and then smoothing the spectrum, it is an object of the present invention to provide a spectrum smoothing apparatus, a coding apparatus, a decoding apparatus, a communication terminal apparatus, a base station apparatus and a spectrum smoothing method, whereby good speech quality is maintained and the amount of calculation processing can be reduced substantially.

Solution to Problem

The spectrum smoothing apparatus according to the present invention employs a configuration to include: a time-frequency transformation section that performs a time-frequency transformation of an input signal and generates a frequency component; a subband dividing section that divides the frequency component into a plurality of subbands; a representative value calculating section that calculates a representative value of each divided subband by calculating an arithmetic mean and by using a multiplication calculation using a calculation result of the arithmetic mean; a non-linear transformation section that performs a non-linear transformation of representative values of the subbands; and a smoothing section that smoothes the representative values subjected to the non-linear transformation in the frequency domain.

The spectrum smoothing method according to the present invention includes: a time-frequency transformation step of performing a time-frequency transformation of an input signal and generates a frequency component; a subband division step of dividing the frequency component into a plurality of subbands; a representative value calculation step of calculating a representative value of each divided subband by calculating an arithmetic mean and by using a multiplication calculation using a calculation result of the arithmetic mean; a non-linear transformation step of performing a non-linear transformation of representative values of the subbands; and a smoothing step of smoothing the representative values subjected to the non-linear transformation in the frequency domain.

Advantageous Effects of Invention

With the present invention, it is possible to maintain good speech quality and reduce the amount of calculation processing substantially.

DESCRIPTION OF EMBODIMENTS

Embodiments of the present invention will be described in detail with reference to the accompanying drawings.

Embodiment 1

First, an overview of the spectrum smoothing method according to an embodiment of the present invention will be described using FIG. 1. FIG. 1 shows spectrum diagrams for explaining an overview of the spectrum smoothing method according to the present embodiment.

Figure 1A:
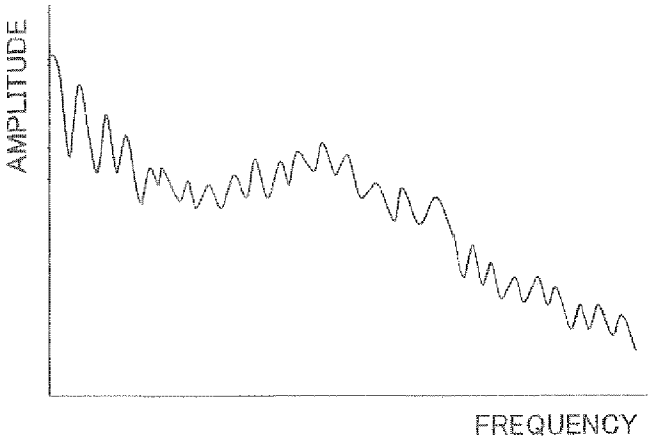
FIG. 1 provides spectrum overviews showing an overview of processing according to embodiment 1 of the present invention.
Figure 1B:
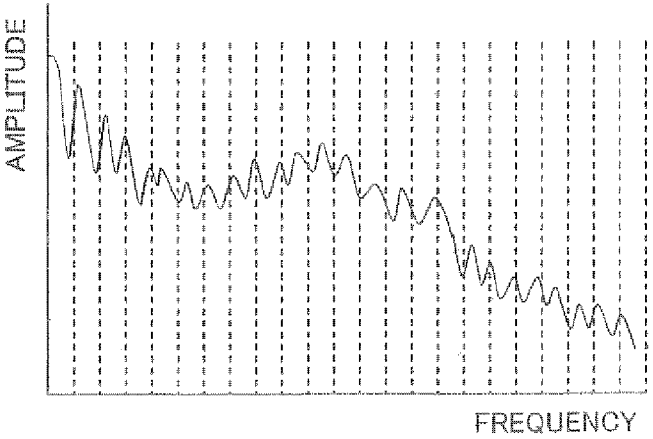

FIG. 1A shows a spectrum of an input signal. With the present embodiment, first, an input signal spectrum is divided into a plurality of subbands. FIG. 1B shows how an input signal spectrum is divided into a plurality of subbands. The spectrum diagram of FIG. 1 is for explaining an overview of the present invention, and the present invention is by no means limited to the number of subbands shown in the drawing.

Next, a representative value of each subband is calculated. To be more specific, samples in a subband are further divided into a plurality of subgroups. Then, an arithmetic mean of absolute spectrum values is calculated per subgroup.

Next, a geometric mean of the arithmetic mean values of individual subgroups is calculated per subband. This geometric mean value is not an accurate geometric mean value yet, and, at this point, a value that is obtained by simply multiplying individual groups' arithmetic mean values may be calculated, and an accurate geometric mean value may be found after non-linear transformation (described later). The above processing is to reduce the amount of calculation processing, and it is equally possible to find an accurate geometric mean value at this point.

Figure 1C:
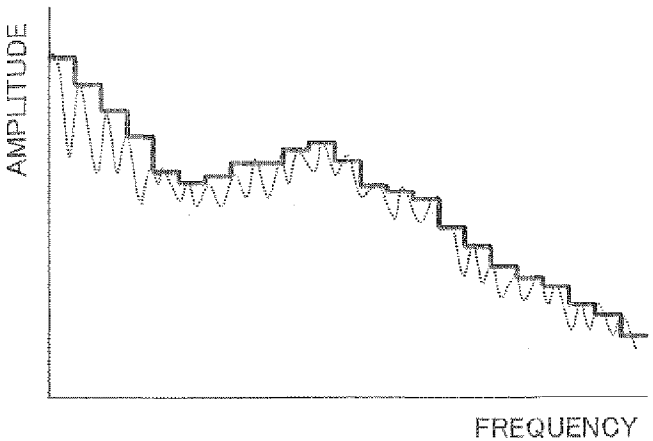

A geometric mean value found this way may be used as a representative value of each subband. FIG. 1C shows representative values of individual subbands over an input signal spectrum shown with dotted lines. For ease of explanation, FIG. 1C shows accurate geometric mean values as representative values, instead of values obtained by simply multiplying arithmetic mean values of individual subgroups.

Figure 1D:
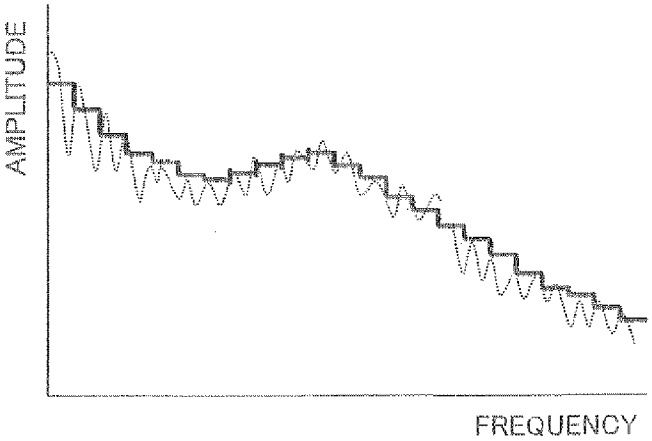

Next, referring to each subband's representative value, non-linear transformation (for example, logarithmic transform) is performed for a spectrum of an input signal such that greater spectrum power values are emphasized, and then smoothing processing is performed in the frequency domain. Afterward, inverse non-linear transformation (for example, inverse logarithmic transform) is performed, and a smoothed spectrum is calculated in each subband. FIG. 1D shows a smoothed spectrum of each subband over an input signal spectrum shown with dotted lines.

By means of this processing, it is possible to perform spectrum smoothing in the logarithmic domain while reducing speech quality degradation and reducing the amount of calculation processing substantially. Now, a configuration of a spectrum smoothing apparatus providing the above advantage, according to an embodiment of the present invention, will be described.

The spectrum smoothing apparatus according to the present embodiment smoothes an input spectrum, and outputs the spectrum after the smoothing (hereinafter "smoothed spectrum") as an output signal. To be more specific, the spectrum smoothing apparatus divides an input signal every N samples (where N is a natural number), and performs smoothing processing per frame using N samples as one frame. Here, an input signal that is subject to smoothing processing is represented as "$x_n$" (n=0, . . . , N−1).

Figure 2:
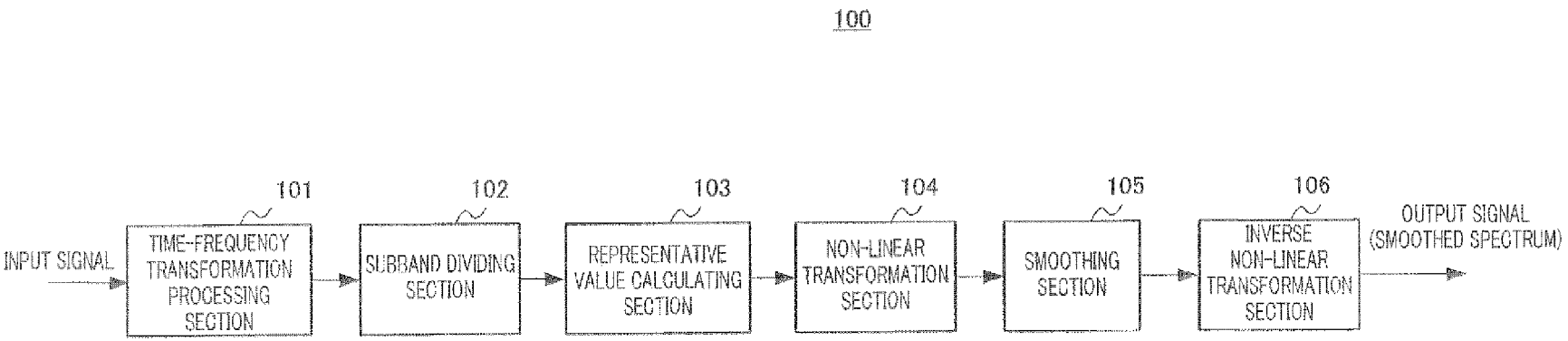
FIG. 2 is a block diagram showing a principal-part configuration of a spectrum smoothing apparatus according to embodiment 1.

FIG. 2 shows a principal-part configuration of spectrum smoothing apparatus 100 according to the present embodiment.

Spectrum smoothing apparatus 100 shown in FIG. 2 is primarily formed with time-frequency transformation processing section 101, subband dividing section 102, representative value calculating section 103, non-linear transformation section 104, smoothing section 105 and inverse non-linear transformation section 106.

Time-frequency transformation processing section 101 applies a fast Fourier transform (FFT) to input signal $x_n$ and finds a frequency component spectrum S1($k$) (hereinafter "input spectrum").

Then, time-frequency transformation processing section 101 outputs input spectrum S1($k$) to subband dividing section 102.

Subband dividing section 102 divides input spectrum S1($k$) received as input from time-frequency transformation processing section 101, into P subbands (where P is an integer equal to or greater than 2). Now, a case will be described below where subband dividing section 102 divides input spectrum S1($k$) such that each subband contains the same number of samples. The number of samples may vary between subbands. Subband dividing section 102 outputs the spectrums divided per subband (hereinafter "subband spectrums"), to representative value calculating section 103.

Representative value calculating section 103 calculates a representative value for each subband of an input spectrum divided into subbands, received as input from subband dividing section 102, and outputs the representative value calculated per subband, to non-linear transformation section 104.

The processing in representative value calculating section 103 will be described in detail later.

Figure 3:
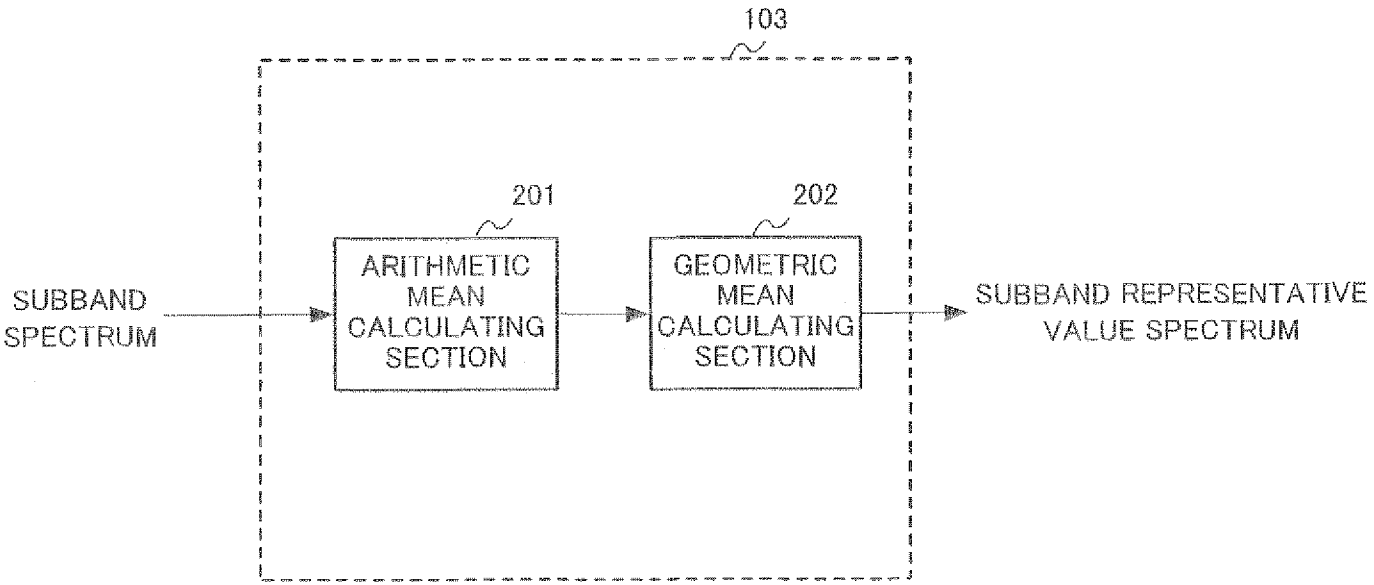
FIG. 3 is a block diagram showing a principal-part configuration of a representative value calculating section according to embodiment 1.

FIG. 3 shows an inner configuration of representative value calculating section 103. Representative value calculating section 103 shown in FIG. 3 has arithmetic mean calculating section 201, and geometric mean calculating section 202.

First, subband dividing section 102 outputs a subband spectrum to arithmetic mean calculating section 201.

Arithmetic mean calculating section 201 divides each subband of the subband spectrum received as input into Q subgroups of subgroup 0, subgroup Q−1, etc. (where Q is an integer equal to or greater than 2). Now, a case will be described below where Q subgroups are each formed with R samples (R is an integer equal to or greater than 2). Although a case will be described below where Q subgroups are all formed with R samples, the number of samples may vary between subgroups.

Figure 4:
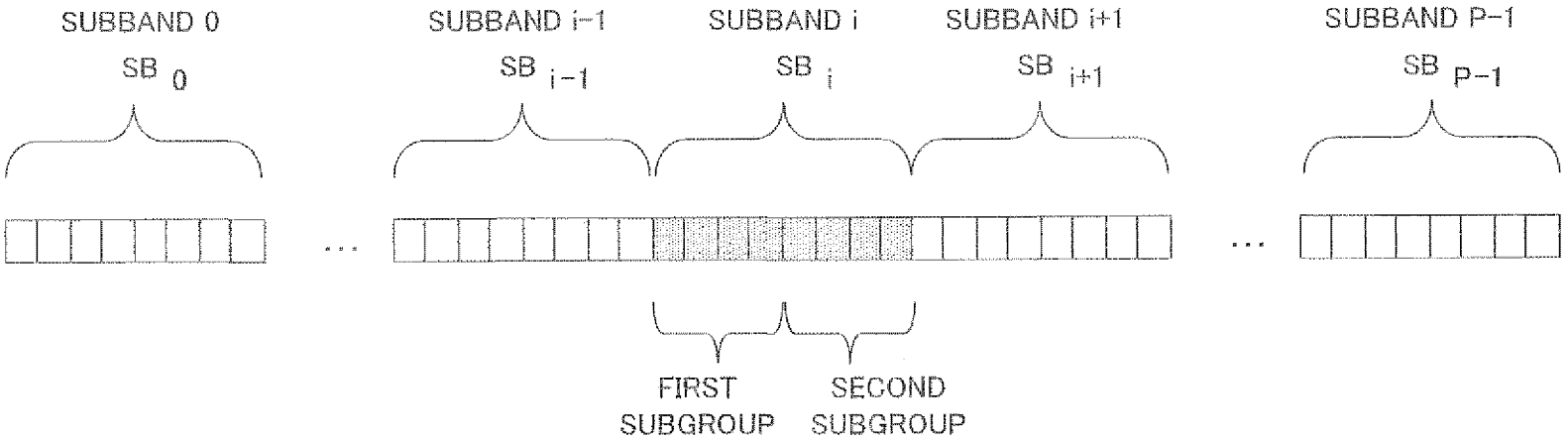
FIG. 4 is an overview showing a configuration of subbands and subgroups of an input signal according to embodiment 1.

FIG. 4 shows a sample configuration of subbands and subgroups. FIG. 4 shows, as an example, a case where the number of samples to constitute one subband is eight, the number of subgroups Q to constitute one subband is two and the number of samples R in one subgroup is four.

Next, for each of the Q subgroups, arithmetic mean calculating section 201 calculates an arithmetic mean of the absolute values of the spectrums (FFT coefficients) contained in each subgroup, using equation 1.

(Equation 1)

$$AVE1_q = \frac{1}{R}\sum_{i=0}^{R-1} |S1_{BS_q+i}| \quad (q = 0, \ldots Q-1) \qquad [1]$$

In equation 1, AVE1$_q$ is an arithmetic mean of the absolute values of the spectrums contained in subgroup q, and $BS_q$ is the index of the leading sample in subgroup q.

Next, arithmetic mean calculating section 201 outputs arithmetic mean value spectrums calculated per subband, AVE1$_q$ (q=0~Q−1) (subband arithmetic mean value spectrums), to geometric mean calculating section 202.

Geometric mean calculating section 202 multiplies arithmetic mean value spectrums AVE1$_q$ (q=0~Q−1) of all subbands received as input from arithmetic mean calculating section 201, as shown in equation 2, and calculates a representative spectrum, AVE2$_p$ (p=0~P−1), for each subband.

(Equation 2)

$$AVE2_p = \prod_{i=0}^{Q-1} AVE1_i \quad (p = 0, \ldots P-1) \qquad [2]$$

In equation 2, P is the number of subbands.

Next, geometric mean calculating section 202 outputs calculated subband representative value spectrums AVE2$_p$ (p=0~P−1) to non-linear transformation section 104.

Non-linear transformation section 104 applies non-linear transformation having a characteristic of emphasizing greater representative values, to subband representative value spectrums AVE2$_p$, received as input from geometric mean calculating section 202, using equation 3, and calculates first subband logarithmic representative value spectrums, AVE3$_p$ (p=0~P−1). A case will be described here where logarithmic transform is performed as non-linear transformation processing.

[3]

$$AVE3_p = \log_{10}(AVE2_p)(p=0, \ldots P-1) \qquad \text{(Equation 3)}$$

Next, a second subband logarithmic representative value spectrum, AVE4$_p$ (p=0~P−1), is calculated by multiplying calculated first subband logarithmic representative value spectrum, AVE3$_p$ (p=0~P−1) by the reciprocal of the number of subgroups, Q, using equation 4.

(Equation 4)

$$AVE4_p = \frac{AVE3_p}{Q} \quad (p = 0, \ldots P-1) \qquad [4]$$

Although in the processing of equation 2 in geometric mean calculating section 202 subband arithmetic mean value spectrums AVE1$_p$ of individual subbands are simply multiplied, in the processing of equation 4 in non-linear transformation section 104, a geometric mean is calculated. With the present embodiment, transformation into the logarithmic domain is performed using equation 3, and then multiplication by the reciprocal of the number of subgroups, Q, is performed using equation 4. By this means, radical root calculation, which involves a large amount of calculation, can be replaced by simple division. Furthermore, when the number of subgroups, Q, is a constant, the radical root calculation can be replaced by simple multiplication, by calculating the reciprocal of Q in advance, so that the amount of calculation can be reduced further.

Next, non-linear transformation section 104 outputs second subband logarithmic representative value spectrums AVE4$_9$ (p=0~P−1) calculated using equation 4, to smoothing section 105.

Referring back to FIG. 2 again, smoothing section 105 smoothes second subband logarithmic representative value spectrums AVE4$_p$ (p=0~P−1) received as input from non-linear transformation section 104, in the frequency domain, using equation 5, and calculates logarithmic smoothed spectrums AVE5$_p$ (p=0~P−1).

(Equation 5)

$$AVE5_p = \frac{1}{\text{MA_LEN}} \cdot \sum_{i=p-\frac{\text{MA_LEN}-1}{2}}^{p+\frac{\text{MA_LEN}-1}{2}} AVE4_i \cdot W_i \left(\frac{\text{MA_LEN}-1}{2} \le p \le P-1-\frac{\text{MA_LEN}-1}{2}\right) \qquad [5]$$

Equation 5 represents smoothing filtering processing, and, in this equation 5, MA_LEN is the order of smoothing filtering and $W_i$ is the smoothing filter weight.

Furthermore, in equation 5 provides a method of calculating a logarithmic smoothed spectrum when subband index p is p>=(MA_LEN−1)/2 and p<=P−1−(MA_LEN−1)/2. When subband index p is at the top or near the last, spectrums are smoothed using equation 6 and equation 7 taking into account the boundary conditrions.

(Equation 6)

$$AVE5_p = \frac{1}{p + \frac{\text{MA_LEN} - 1}{2} + 1} \cdot \sum_{i=0}^{p+\frac{\text{MA_LEN}-1}{2}} AVE4_i \cdot W_i \left(0 \le p < \frac{\text{MA_LEN} - 1}{2}\right) \quad [6]$$

(Equation 7)

$$AVE5_p = \frac{1}{P - 1 - p + \frac{\text{MA_LEN} - 1}{2} + 1} \cdot \sum_{i=p-\frac{\text{MA_LEN}-1}{2}}^{P-1} AVE4_i \cdot W_i \left(P - 1 - \frac{\text{MA_LEN} - 1}{2} < p \le P - 1\right) \quad [7]$$

Furthermore, smoothing section 105 performs smoothing based on simple moving average, as smoothing processing by smoothing filtering processing, as described above (when $W_i$ is 1 for all i's, smoothing is performed based on moving average). For the window function (weight), Hanning window or other window functions may be used.

Next, smoothing section 105 outputs calculated smoothed spectrums AVE$\mathbf{5}_p$ (p=0~P−1) to inverse non-linear transformation section 106.

Inverse non-linear transformation section 106 performs inverse logarithmic transformation as inverse non-linear transformation for logarithmic smoothed spectrums AVE$\mathbf{5}_p$ (p=0~P−1) received as input from smoothing section 105. Inverse non-linear transformation section 106 performs inverse logarithmic transformation for logarithmic smoothed spectrums AVE$\mathbf{5}_p$ (p=0~P−1) using equation 8, and calculates smoothed spectrum AVE$\mathbf{6}_p$ (p=0~P−1).

[8]

$$AVE6_p = 10^{AVE5_p} (p=0, \ldots P-1) \quad \text{(Equation 8)}$$

Furthermore, inverse non-linear transformation section 106 calculates a smoothed spectrum of all samples using the values of samples in each subband as the values of linear domain smoothed spectrum AVE$\mathbf{6}_p$ (p=0~P−1).

Inverse non-linear transformation section 106 outputs the smoothed spectrum values of all samples as a processing result of spectrum smoothing apparatus 100.

The spectrum smoothing apparatus and spectrum smoothing method according to the present invention have been described.

As described above, with the present embodiment, subband dividing section 102 divides an input spectrum into a plurality of subbands, representative value calculating section 103 calculates representative value per subband using an arithmetic mean or geometric mean, non-linear transformation section 104 performs non-linear transformation having a characteristic of emphasizing greater values to each representative value, and smoothing section 105 smoothes representative values subjected to non-linear transformation per subband in the frequency domain.

Thus, all samples of a spectrum are divided into a plurality of subbands, and, for each subband, a representative value is found by combining an arithmetic mean with multiplication calculation or geometric mean, and then smoothing is performed after the representative value is subjected to non-linear transformation, so that it is possible to maintain good speech quality and reduce the amount of calculation processing substantially.

As described above, the present invention employs a configuration for calculating representative values of subbands by combining arithmetic means and geometric means of samples in subbands, so that it is possible to prevent speech quality degradation that can occur due to the variation of the scale of sample values in a subband when average values in the linear domain are used simply as representative values of subbands.

Although the fast Fourier transform (FFT) has been explained as an example of time-frequency transformation processing with the present embodiment, the present invention is by no means limited to this, and other time-frequency transformation methods besides the fast Fourier transform (FFT) are equally applicable. For example, according to patent literature 1, upon calculation of perceptual masking values (see FIG. 2), the modified discrete cosine transform (MDCT), not the fast Fourier transform (FFT), is used to calculate frequency components (spectrum). Thus, the present invention is applicable to configurations using the modified discrete cosine transform (MDCT) and other time-frequency transformation methods in a time-frequency transformation processing section.

In the configuration described above, geometric mean calculating section 202 multiplies an arithmetic mean value spectrum AVE$\mathbf{1}_4$ (q=0~Q−1), and does not calculate radical roots. That is to say, strictly speaking, geometric mean calculating section 202 does not calculate geometric mean values, because, as explained above, in non-linear transformation section 104, transformation into the logarithmic domain is performed using equation 3 as non-linear transformation processing and then multiplication by the reciprocal of the number of subgroups Q is performed using equation 4, so that it is possible to replace radical root calculation by simple division (multiplication) and consequently reduce the amount of calculation.

Consequently, the present invention is not necessarily limited to the above configuration. The present invention is equally applicable to, for example, a configuration for multiplying, in geometric mean calculating section 202, arithmetic mean value spectrums AVE$\mathbf{1}_9$ (q=0~Q−1) by the values of arithmetic mean value spectrums per subband, and then calculating a radical root of the number of subgroups and outputting the calculated radical root to non-linear transformation section 104 as subband representative value spectrums AVE$\mathbf{2}_p$ (p=0~P−1). Either way, smoothing section 105 is able to acquire a representative value having been subjected to non-linear transformation, per subband. In this case, the calculation of equation 4 in non-linear transformation section 104 may be omitted.

A case has been described above with the present embodiment where a representative value of each subband is calculated by, first, calculating an arithmetic mean value of a subgroup, and next finding a geometric mean value of the arithmetic mean values of all subgroups in a subband. However, the present invention is by no means limited to this and is equally applicable to a case where, for example, the number of samples to constitute a subgroup is one, that is, a case where a geometric mean value of all samples in a subband is used as a representative value of the subband without calculating an arithmetic mean value of each subgroup. In this configuration again, as described above, rather than calculating an accurate geometric mean value, it is possible to calculate a geometric mean value in the logarithmic domain by performing non-linear transformation and then performing multiplication by the reciprocal of the number of subgroups.

In the above description, all samples in a subband have the same spectrum value in inverse non-linear transformation section 106. However, the present invention is by no means limited to this, and it is equally possible to provide an inverse smoothing processing section after inverse non-linear transformation section 106 so that the inverse smoothing processing section may assign weight to samples in each subband and perform inverse smoothing processing. This inverse smoothing processing needs not be completely opposite to smoothing section 105.

Although a case has been described with the above description where non-linear transformation section 104 performs inverse logarithmic transformation as inverse non-linear transformation processing and inverse non-linear transformation section 106 performs inverse logarithmic transformation as inverse non-linear transformation processing, this is by no means limiting, and it is equally possible to use power transform and others and perform inverse processing of non-linear transformation as inverse non-linear transformation processing. However, given that calculation of a radical root can be replaced by simple division (multiplication) by multiplying the reciprocal of the number of subgroups Q using equation 4, the fact that non-linear transformation section 104 performs logarithmic transform as non-linear transformation, should be credited for the reduction of the amount of calculation. Consequently, if processing that is different from logarithmic transform is performed as non-linear transformation processing, it is then equally possible to calculate a representative value per subband by calculating a geometric mean value of arithmetic mean values of subgroups and apply non-linear processing to the representative values.

Furthermore, as for the number of subbands and, the number of subgroups, if, for example, the sampling frequency of an input signal is 32 kHz and one frame is 20 msec long, that is, if an input signal is comprised of 640 samples, it is possible to, for example, set the number of subbands to eighty, the number of subgroups to two, the number of samples per subgroup to four, and the order of smoothing filtering to seven, for example. The present invention is by no means limited to this setting and is equally applicable to cases where different values are applied.

The spectrum smoothing apparatus and spectrum smoothing method according to the present invention are applicable to any and all of spectrum smoothing devices or components that perform smoothing in the spectral domain, including speech coding apparatus and speech coding method, speech decoding apparatus and speech decoding method, and speech recognition apparatus and speech recognition method. For example, although, with the bandwidth enhancement technique disclosed in patent literature 2, processing for calculating a spectral envelope from LPCs (Linear Predictive Coefficients), and, based on this calculated spectral envelope, removing the spectral envelope from the lower band spectrum, is used to calculate parameters for generating a higher band spectrum, it is equally possible to use a smoothed spectrum calculated by applying the spectrum smoothing method according to the present invention to a lower band spectrum instead of the spectral envelope used in spectral envelope removing processing in patent literature 2.

Furthermore, although a configuration has been explained with the present embodiment where an input spectrum $S1(k)$ is divided into P subbands (where P is an integer equal to or greater than 2) all having the same number of samples, the present invention is by no means limited to this and is equally applicable to a configuration in which the number of samples varies between subbands. For example, a configuration is possible in which subbands are divided such that a subband on the lower band side has a smaller number of samples and a subband on the higher band side has a greater number of samples. Generally speaking, in human perception, frequency resolution decreases in the higher band side, so that more efficient spectrum smoothing is made possible with the above configuration. The same applies to subgroups to constitute each subband. Although a case has been described above with the present embodiment where Q subgroups are all formed with R samples, the present invention is by no means limited to this, and is equally applicable to configurations where subgroups are divided such that a subgroup on the lower band side has a smaller number of samples and a subgroup on the higher band side has a larger number of samples.

Although weighted moving average has been described as an example of smoothing processing with the present embodiment, the present invention is by no means limited to this and is equally applicable to various smoothing processing. For example, as described above, in a configuration in which the number of samples varies between subbands (that is, the number of samples increases in the higher band), it is possible to make the number of taps in a moving average filter not the same between the left and the right and increase the number of taps in the higher band. When the number of samples increases in subbands in the higher band, it is possible to perform perceptually more adequate smoothing processing by using a moving average filter having a small number of taps in the higher band side. The present invention is applicable to cases using a moving average filter that is asymmetrical between the left and the right and has a greater number of taps on the higher band side.

Embodiment 2

A configuration will be described now with the present embodiment where the spectrum smoothing processing explained with embodiment 1 is used in preparatory processing upon band enhancement coding disclosed in patent literature 2.

Figure 5:
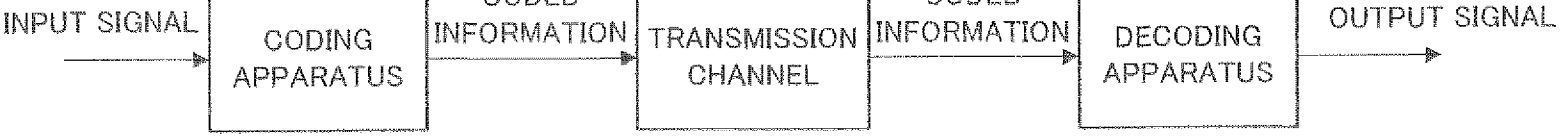
FIG. 5 is a block diagram showing a configuration of a communication system having a coding apparatus and decoding apparatus according to embodiment 2 of the present invention.

FIG. 5 is a block diagram showing a configuration of a communication system having a coding apparatus and decoding apparatus according to embodiment 2. In FIG. 5, the communication system has a coding apparatus and decoding apparatus that are mutually communicable via a transmission channel. The coding apparatus and decoding apparatus are usually mounted in a base station apparatus and communication terminal apparatus for use.

Coding apparatus 301 divides an input signal every N samples (where N is a natural number) and performs coding on a per frame basis using N samples as one frame. The input signal to be subject to coding is represented as $x_n$ (n=0, . . . , N−1). n is the (n+1)-th signal component in the input signal divided every N samples. Input information having been subjected to coding (coded information) is transmitted to decoding apparatus 303 via transmission channel 302.

Decoding apparatus 303 receives the coded information transmitted from coding apparatus 301 via transmission channel 302, and, by decoding this, acquires an output signal.

Figure 6:
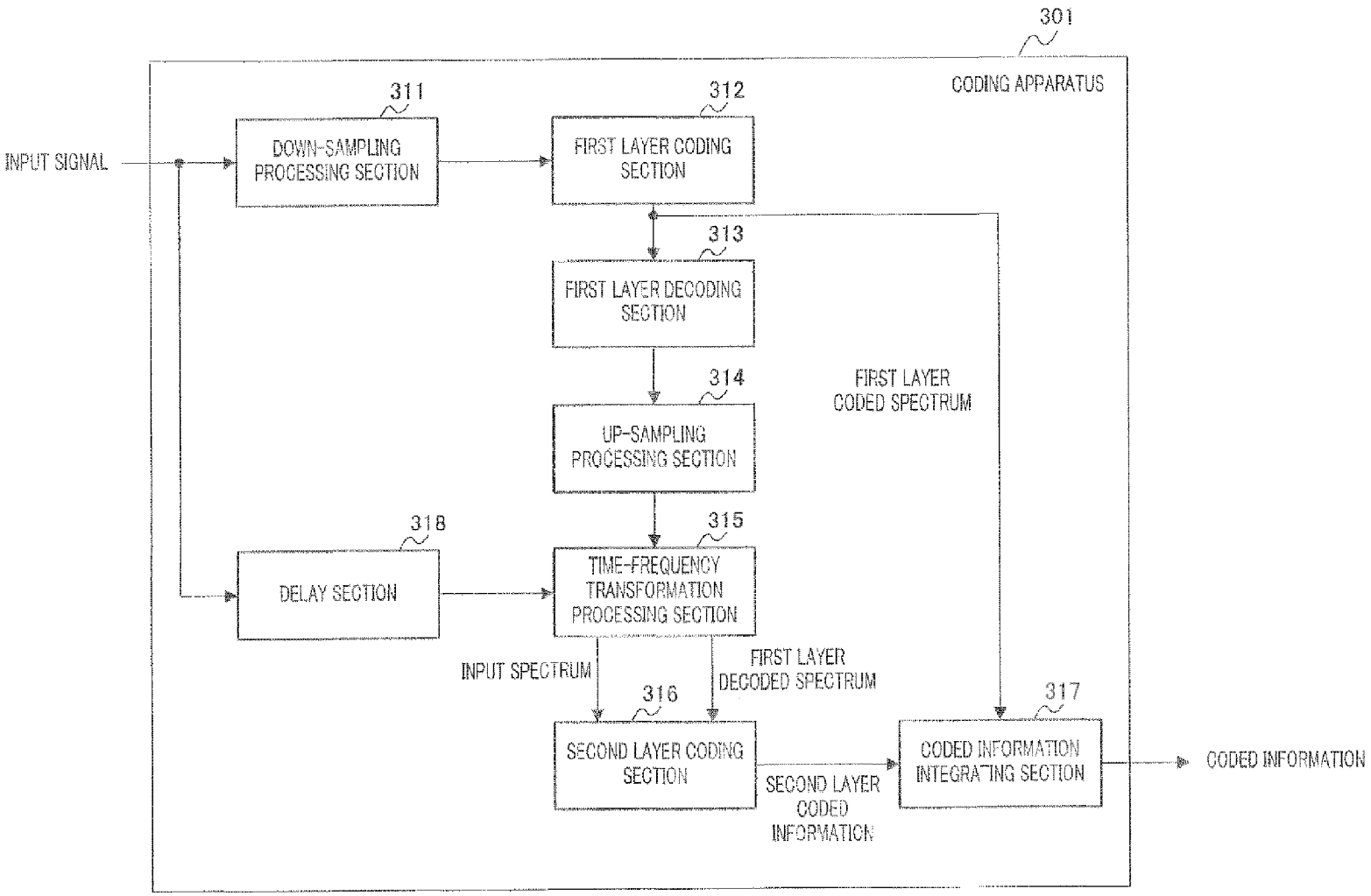
FIG. 6 is a block diagram showing an inner principal-part of the coding apparatus according to embodiment 2 shown in FIG. 5.

FIG. 6 is a block diagram showing an inner principal-part configuration of coding apparatus 301. If input signal sampling frequency is $SR_{input}$, down-sampling processing section 311 down-samples the input signal sampling frequency from $SR_{input}$ to $SR_{base}$ ($SR_{base}<SR_{input}$), and outputs input signal after down-sampling to first layer coding section 312 as a down-sampled input signal.

First layer coding section 312 generates first layer coded information by encoding the down-sampled input signal received as input from down-sampling processing section 311, using a speech coding method of a CELP (Code Excited Linear Prediction) scheme, and outputs the generated first layer coded information to first layer decoding section 313 and coded information integrating section 317.

First layer decoding section 313 generates a first layer decoded signal by decoding the first layer coded information received as input from first layer coding section 312, using, for example, a CELP speech decoding method, and outputs the generated first layer decoded signal to up-sampling processing section 314.

Up-sampling processing section 314 up-samples the sampling frequency of the input signal received as input from first layer decoding section 313 from $SR_{base}$ to $SR_{input}$, and outputs the first layer decoded signal after up-sampling to time-frequency transformation processing section 315 as an up-sampled first layer decoded signal.

Delay section 318 gives a delay of a predetermined length, to the input signal. This delay is to correct the time delay in down-sampling processing section 311, first layer coding section 312, first layer decoding section 313, and up-sampling processing section 314.

Time-frequency transformation processing section 315 has buffer $buf1_n$ and $buf2_{11}$ (n=0, . . . , N−1) inside, and applies a modified discrete cosine transform (MDCT) to input signal $x_n$ and up-sampled first layer decoded signal $y_n$ received as input from up-sampling processing section 314.

Next, the orthogonal transformation processing in time-frequency transformation processing section 315 will be described as to its calculation step and data output to internal buffers.

First, time-frequency transformation processing section 315 initializes $buf1_n$ and $buf2_n$ using the initial value "0" according to equation 9 and equation 10 below.

[9]

$$buf1_n=0(n=0, \ldots, N-1) \quad \text{(Equation 9)}$$

[10]

$$buf2_n=0(n=0, \ldots, N=1) \quad \text{(Equation 10)}$$

Next, time-frequency transformation processing section 315 performs an MDCT of input signal $x_n$ and up-sampled first layer decoded signal $y_n$, and finds MDCT coefficient S2($k$) of the input signal (hereinafter "input spectrum") and MDCT coefficient S1($k$) of up-sampled first layer decoded signal $y_n$ (hereinafter "first layer decoded spectrum").

(Equation 11)

$$S2(k) = \frac{2}{N}\sum_{n=0}^{2N-1} x'_n \cos\left[\frac{(2n+1+N)(2k+1)\pi}{4N}\right] \quad [11]$$

$$(k = 0, \ldots, N-1)$$

(Equation 12)

$$S1(k) = \frac{2}{N}\sum_{n=0}^{2N-1} y'_n \cos\left[\frac{(2n+1+N)(2k+1)\pi}{4N}\right] \quad [12]$$

$$(k = 0, \ldots, N-1)$$

K is the index of each sample in a frame. Time-frequency transformation processing section 315 finds $x_n'$, which is a vector combining input signal $x_n$ and buffer $bun1_n$ from equation 13 below. Time-frequency transformation processing section 315 also finds $y_n'$ which is a vector combining up-sampled first layer decoded signal $y_n$ and buffer $buf2_n$.

(Equation 13)

$$x'_n = \begin{cases} buf1_n & (n = 0, \ldots N-1) \\ x_{n-N} & (n = N, \ldots 2N-1) \end{cases} \quad [13]$$

(Equation 14)

$$y'_n = \begin{cases} buf2_n & (n = 0, \ldots N-1) \\ y_{n-N} & (n = N, \ldots 2N-1) \end{cases} \quad [14]$$

Next, time-frequency transformation processing section 315 updates buffer $buf1_n$ and $buf2_n$ using equation 15 and equation 16.

[15]

$$buf1_n=x_n(n=0, \ldots N-1) \quad \text{(Equation 15)}$$

[16]

$$buf2_n=y_n(n=0, \ldots N-1) \quad \text{(Equation 16)}$$

Then, time-frequency transformation processing section 315 outputs input spectrum S2($k$) and first layer decoded spectrum S1($k$) to second layer coding section 316.

Second layer coding section 316 generates second layer coded information using input spectrum S2($k$) and first layer decoded spectrum S1($k$) received as input from time-frequency transformation processing section 315, and outputs the generated second layer coded information to coded information integrating section 317. The details of second layer coding section 316 will be described later.

Coded information integrating section 317 integrates the first layer coded information received as input from first layer coding section 312 and the second layer coded information received as input from second layer coding section 316, and, if necessary, attaches a transmission error correction code to the integrated information source code, and outputs the result to transmission channel 302 as coded information.

Figure 7:
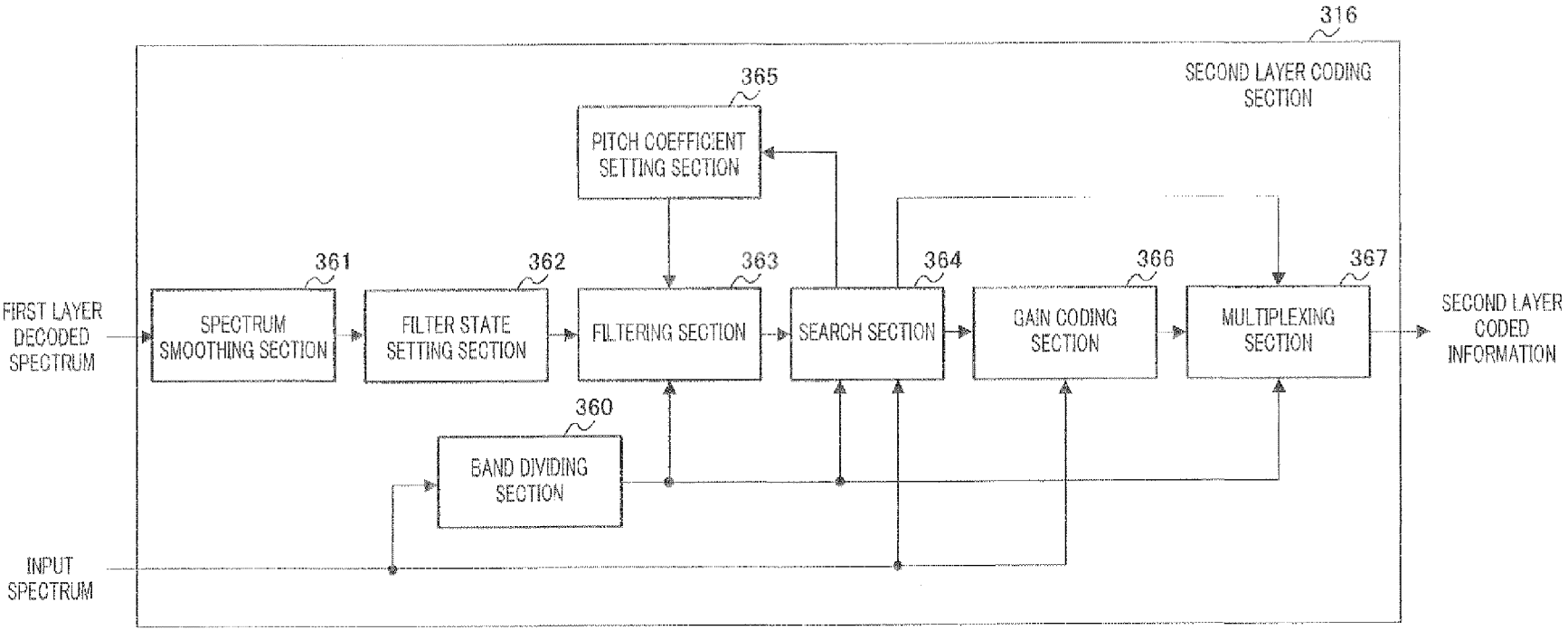
FIG. 7 is a block diagram showing an inner principal-part configuration of the second layer coding section according to embodiment 2 shown in FIG. 6.

Next, the inner principal-part configuration of second layer coding section 316 shown in FIG. 6 will be described using FIG. 7.

Second layer coding section 316 has band dividing section 360, spectrum smoothing section 361, filter state setting section 362, filtering section 363, search section 364, pitch coefficient setting section 365, gain coding section 366 and multiplexing section 367, and these sections perform the following operations.

Band dividing section 360 divides the higher band part (FL<=k<FH) of input spectrum S2($k$) received as input from time-frequency transformation processing section 315 into P subbands $SB_p$ (p=0, 1, . . . , P−1). Then, band dividing section 360 outputs bandwidth. $BW_p$ (p=0, 1, . . . , P−1) and leading index $BS_p$ (p=0, 1, . . . , P−1) (FL<=$BS_p$<FH) of each divided subband to filtering section 363, search section 364 and multiplexing section 367 as band division information. The part in input spectrum S2($k$) corresponding to subband $SB_p$ will be referred to as subband spectrum $S2_p$(k) ($BS_p$<=k<$BS_p$+$BW_p$).

Spectrum smoothing section 361 applies smoothing processing to first layer decoded spectrum S1($k$) (0<=k<FL) received as input from time-frequency transformation processing section 315, outputs smoothed first layer decoded spectrum S1'($k$) (0<=k<FL) after smoothing processing, to filter state setting section 362.

Figure 8:
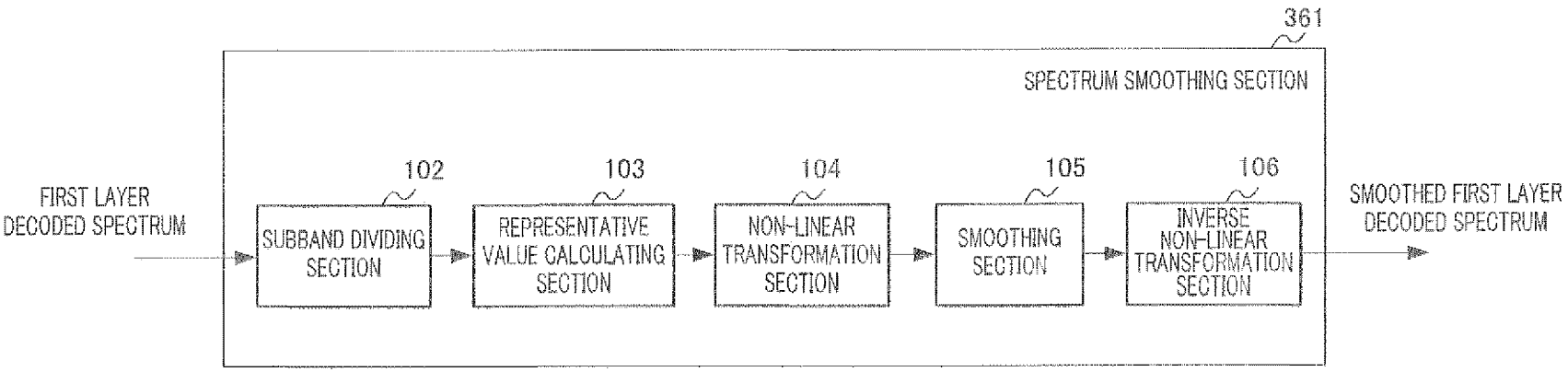
FIG. 8 is a block diagram showing a principal-part configuration of the spectrum smoothing apparatus according to embodiment 2 shown in FIG. 7.

FIG. 8 shows an internal configuration of spectrum smoothing section 361. Spectrum smoothing section 361 is primarily configured with subband dividing section 102, representative value calculating section 103, non-linear transformation section 104, smoothing section 105, and inverse non-linear transformation section 106. These components are the same as the components described with embodiment 1 and will be assigned the same reference numerals without explanations.

Filter state setting section 362 sets smoothed first layer decoded spectrum S1'($k$) (0<=k<FL) received as input from spectrum smoothing section 361 as the internal filter state to use in subsequent filtering section 363. Smoothed first layer decoded spectrum S1'($k$) is accommodated as the internal filter state (filter state) in the 0<=k<FL band of spectrum S(k) over the entire frequency range in filtering section 363.

Filtering section 363, having a multi-tap pitch filter, filters the first layer decoded spectrum based on the filter state set in filter state setting section 362, the pitch coefficient received as input from pitch coefficient setting section 365 and band division information received as input from band dividing section 360, and calculates estimated spectrum $S2_p'(k)$ ($BS_p$<=k<$BS_p$+$BW_p$) (p=0, 1, . . . , P−1) of each subband $SB_p$ (p=0, 1, . . . , P−1) (hereinafter "subband $SB_p$ estimated spectrum"). Filtering section 363 outputs estimated spectrum $S2_p'(k)$ of subband $SB_p$ to search section 364. The details of filtering processing in filtering section 363 will be described later. The number of multiple taps may be any value (integer) equal to or greater than 1.

Based on band division information received as input from band dividing section 360, search section 364 calculates the degree of similarity between estimated spectrum $S2_p'(k)$ of subband $SB_p$ received as input from filtering section 363, and each subband spectrum $S2_p(k)$ in the higher band (FL<=k<FH) of input spectrum S2($k$) received as input from time-frequency transformation processing section 315. This degree of similarity is calculated by, for example, correlation calculation. Processing in filtering section 363, search section 364 and pitch coefficient setting section 365 constitute closed-loop search processing per subband, and, in every closed loop, search section 364 calculates the degree of similarity with respect to each pitch coefficient by variously modifying pitch coefficient T received as input from pitch coefficient setting section 365 into filtering section 363. In each subband's closed loop, or, for example, in a closed loop corresponding to subband $SB_p$, search section 364 finds optimal pitch coefficient $T_p'$ to maximize the degree of similarity (in the range of Tmin~Tmax), and outputs P optimal pitch coefficients to multiplexing section 367. Search section 364 calculates part of the band of first layer decoded spectrum to resemble each subband $SB_p$ using each optimal pitch coefficient $T_p'$. Then, search section 364 outputs estimated spectrum $S2_p'(k)$ corresponding to each optimal pitch coefficient $T_p'$ (p=0, 1, . . . , P−1), to gain coding section 366. The details of search processing for optimal pitch confident $T_p'$ (p=0, 1, . . . , P−1) in search section 364 will be described later.

Based on control by search section 364, when pitch coefficient setting section 365 performs closed-loop search processing corresponding to first subband $SB_0$ with filtering section 363 and search section 364, modifies pitch coefficient T gradually in a predetermined search range between Tmin and Tmax and sends outputs to filtering section 363 sequentially.

Gain coding section 366 calculates gain information with respect to higher band part (FL<=k<FH) of input spectrum S2($k$) received as input from time-frequency transformation processing section 315. To be more specific, gain coding section 366 divides frequency band FL<=k<FH into J subbands, and finds spectral power of input spectrum S2($k$) per subband. In this case, spectral power $B_j$ of the (j+1)-th subband is represented by equation 17 below.

(Equation 17)

$$B_j = \sum_{k=BL_j}^{BH_j} S2(k)^2 \quad (j = 0, \ldots, J-1) \qquad [17]$$

In equation 17, $BL_j$ is the minimum frequency of the (j+1)-th subband, and $BH_j$ is the maximum frequency of the (j+1)-th subband. Gain coding section 366 forms estimated spectrum S2'($k$) of the higher band of input spectrum by connecting estimated spectrum $S2_p'(k)$ (p=0, 1, . . . , P−1) of each subband received as input from search section 364 continue in the frequency domain. Then, gain coding section 366 calculates spectral power $B'_j$ of estimated spectrum S2'($k$) per subband, as in the case of calculating the spectral power of input spectrum S2($k$), using equation 18 below. Next, gain coding section 366 calculates the amount of variation, $V_j$, of the spectral power of estimated spectrum S2'($k$) per subband, with respect to input spectrum S2($k$), using equation 19 below.

(Equation 18)

$$B'_j = \sum_{k=BL_j}^{BH_j} S2'(k)^2 \quad (j = 0, \ldots, J-1) \qquad [18]$$

(Equation 19)

$$V_j = \sqrt{\frac{B_j}{B'_j}} \quad (j = 0, \ldots, J-1) \qquad [19]$$

Then, gain coding section 366 encodes amount of variation $V_j$, and outputs an index corresponding to coded amount of variation $VQ_j$ to multiplexing section 367.

Multiplexing section 367 multiplexes band division information received as input from band dividing section 360, optimal pitch coefficient $T_p'$ for each subband $SB_p$ (p=0, 1, . . . , P−1) received as input from search section 364, and an index of variation amount $VQ_j$ received as input from gain coding section 366, as second layer coded information, and outputs that second layer coded information to coded information integrating section 317. It is equally possible to input $T_p'$ and the index of $VQ_j$ directly in coded information integrating section 317, and multiplex these with first layer coded information in coded information integrating section 317.

Figure 9:
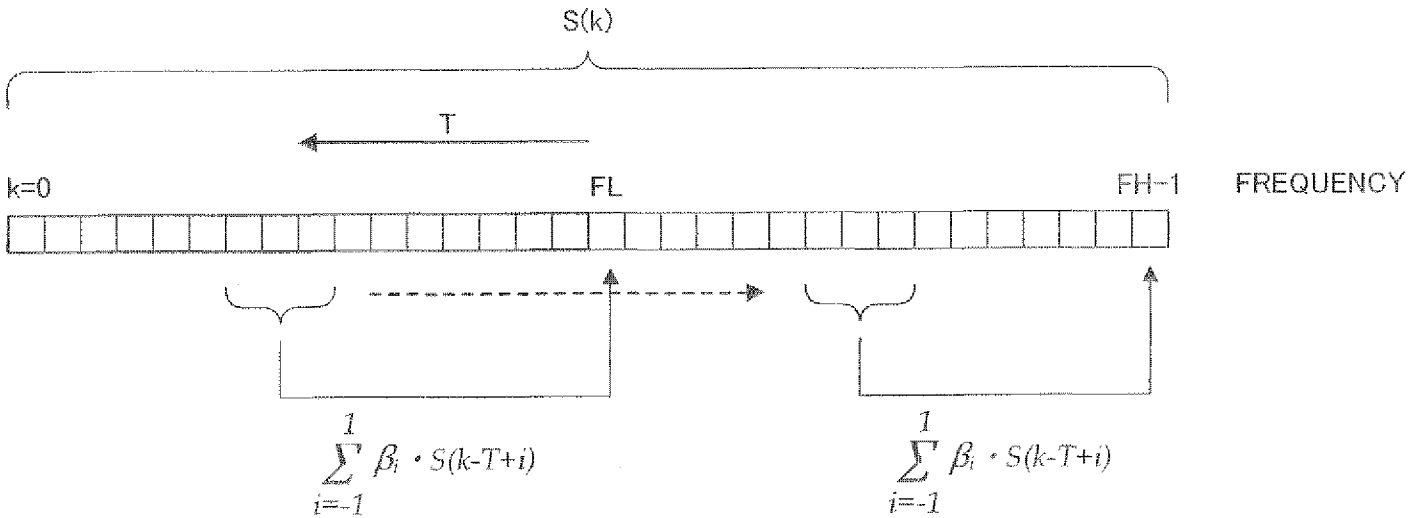
FIG. 9 shows a diagram for explaining the details of the filtering processing in the filtering section according to embodiment 2 shown in FIG. 7.

The details of filtering processing in filtering section 363 shown in FIG. 7 will be described in detail using FIG. 9.

Using the filter state received as input from filter state setting section 362, pitch coefficient T received as input from pitch coefficient setting section 365, and band division information received as input from band dividing section 360, filtering section 363 generates an estimated spectrum in band $BS_p$<=k<$BS_p$+$BW_p$ (p=0, 1, . . . , P−1) of subband $SB_p$ (p=0, 1, . . . , P−1). The transfer function F(z) of the filter used in filtering section 363 is represented by equation 20 below.

Now, using $SB_p$ as an example, the process of generating estimated spectrum $S2_p'(k)$ of subband spectrum $S2_p(k)$ will be explained.

(Equation 20)

$$F(z) = \frac{1}{1 - \sum_{i=-M}^{M} \beta_i z^{-T+i}} \quad [20]$$

In equation 20, T is a pitch coefficient provided from pitch coefficient setting section 365, and $\beta_i$ is a filter coefficient stored inside in advance. For example, when the number of taps is three, filter coefficient candidates include ($\beta_{-1}$, $\beta_0$, $\beta_1$)=(0.1, 0.8, 0.1), for example. Other values such as ($\beta_{-1}$, $\beta_0$, $\beta_1$)=(0.2, 0.6, 0.2), (0.3, 0.4, 0.3) are also applicable. Values ($\beta_{-1}$, $\beta_0$, $\beta_1$)=(0.0, 1.0, 0.0) are also applicable, and, in this case, part of the band 0<=k<FL of first layer decoded spectrum is not modified in shape and copied as is in the band of $BS_p$<=k<$BS_p$+$BW_p$. M=1 in equation 20. M is an indicator related to the number of taps.

Smoothed first layer decoded spectrum S1'($k$) is accommodated in the 0<=k<FL band of spectrum S(k) of the entire frequency band in filtering section 363 as the internal filter state (filter state).

In the $BS_p$<=k<$BS_p$+$BW_p$ band of S(k), estimated spectrum S2$_p$'(k) of subband $SB_p$ is accommodated by filtering processing of the following steps. Basically, in S2$_p$'(k), spectrum S(k−T) having a frequency T lower than this k, is substituted. To improve the smoothness of a spectrum, in practice, spectrum $\beta_i$·S(k−T+i) given by multiplying nearby spectrum S(k−T+i) that is i apart from spectrum S(k−T) by predetermined filter coefficient $\beta_i$ is found with respect to all i's, and a spectrum adding the spectrums of all i's is substituted in S2$_p$'(k). This processing is represented by equation 21 below.

(Equation 21)

$$S2'_p(k) = \sum_{i=-1}^{1} \beta_i \cdot S2(k - T + i)^2 \quad [21]$$

Estimated spectrum S2$_p$'(k) in $BS_p$<=k<$BS_p$+$BW_p$ is calculated by performing the above calculation in order from the lowest frequency and changing k in the range of $BS_p$<=k<$BS_p$+$BW_p$.

The above filtering processing is performed by zero-clearing S(k) in the range $BS_p$<=k<$BS_p$+$BW_p$ every time pitch coefficient T is provided from pitch coefficient setting section 365.

That is to say, S(k) is calculated every time pitch coefficient T changes and outputted to search section 364.

Figure 10:
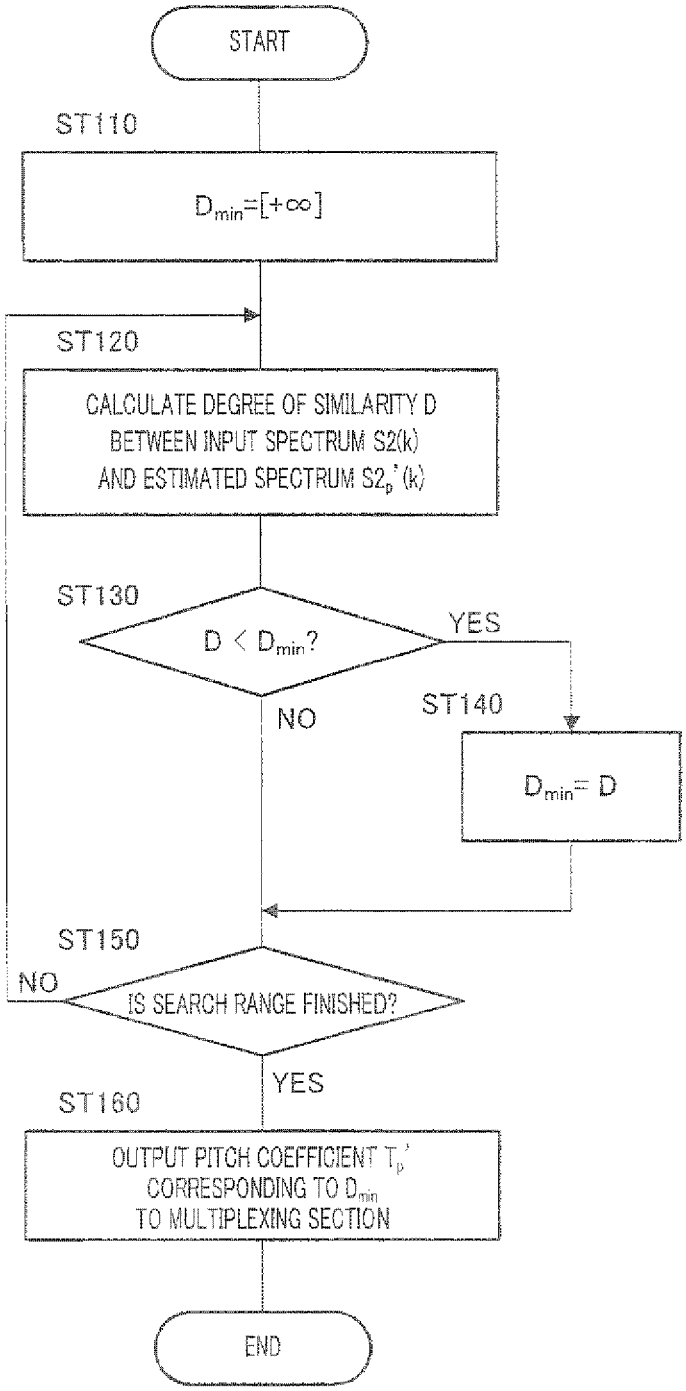
FIG. 10 is a flowchart for explaining the steps of processing for searching for optimal pitch coefficient $T_p'$ with respect to subband $SB_p$ in the search section according to embodiment 2 shown in FIG. 7.

FIG. 10 is a flowchart showing the steps of processing for searching for optimal pitch coefficient $T_p$' for subband $SB_p$ in search section 364. Search section 364 searches for optimal pitch coefficient $T_p$' (p=0, 1, . . . , P−1) in each subband $SB_p$ (p=0, 1, . . . , P−1) by repeating the steps shown in FIG. 10.

First, search section 364 initializes the minimum degree of similarity, $D_{min}$, which is a variable for saving the minimum value of the degree of similarity, to "+8" (ST 110). Next, following equation 22 below, at a given pitch coefficient, search section 364 calculates the degree of similarity, D, between the higher band part (FL<=k<FH) of input spectrum S2($k$) and estimated spectrum S2$_p$'(k) (ST 120).

(Equation 22)

$$D = \sum_{k=0}^{M'} S2(BS_p + k) \cdot S2(BS_p + k) - \frac{\left(\sum_{k=0}^{M'} S2(BS_p + k) \cdot S2'(BS_p + k)\right)^2}{\sum_{k=0}^{M'} S2'(BS_p + k) \cdot S2'(BS_p + k)} \quad [22]$$

$$(0 < M' \le BW_p).$$

In equation 22, M' is the number of samples upon calculating the degree of similarity D, and may assume arbitrary values equal to or smaller than the bandwidth of each subband. S2$_p$'(k) is not present in equation 22 but is represented using $BS_p$ and S2'($k$).

Next, search section 364 determines whether or not the calculated degree of similarity, D, is smaller than the minimum degree of similarity, $D_{min}$ (ST 130). If degree of similarity D calculated in ST 120 is smaller than minimum degree of similarity $D_{min}$ ("YES" in ST 130), search section 364 substitutes degree of similarity D in minimum degree of similarity $D_{min}$ (ST 140). On the other hand, if degree of similarity D calculated in ST 120 is equal to or greater than minimum degree of similarity $D_{min}$ ("NO" in ST 130), search section 364 determines whether or not processing in the search range has finished. That is to say, search section 364 determines whether or not the degree of similarity has been calculated with respect to all pitch coefficients in the search range in ST 120 according to equation 22 above (ST 150). Search section 364 returns to ST 120 again when the processing has not finished over the search range ("NO" in ST 150). Then, search section 364 calculates the degree of similarity according to equation 22, for different pitch coefficients from the case of calculating the degree of similarity according to equation 22 in earlier ST 120. On the other hand, when processing is finished over the search range ("YES" in ST 150), search section 364 outputs pitch coefficient T corresponding to the minimum degree of similarity, to multiplexing section 367, as optimal pitch coefficient $T_p$' (ST 160).

Next, decoding apparatus 303 shown in FIG. 5 will be described.

Figure 11:
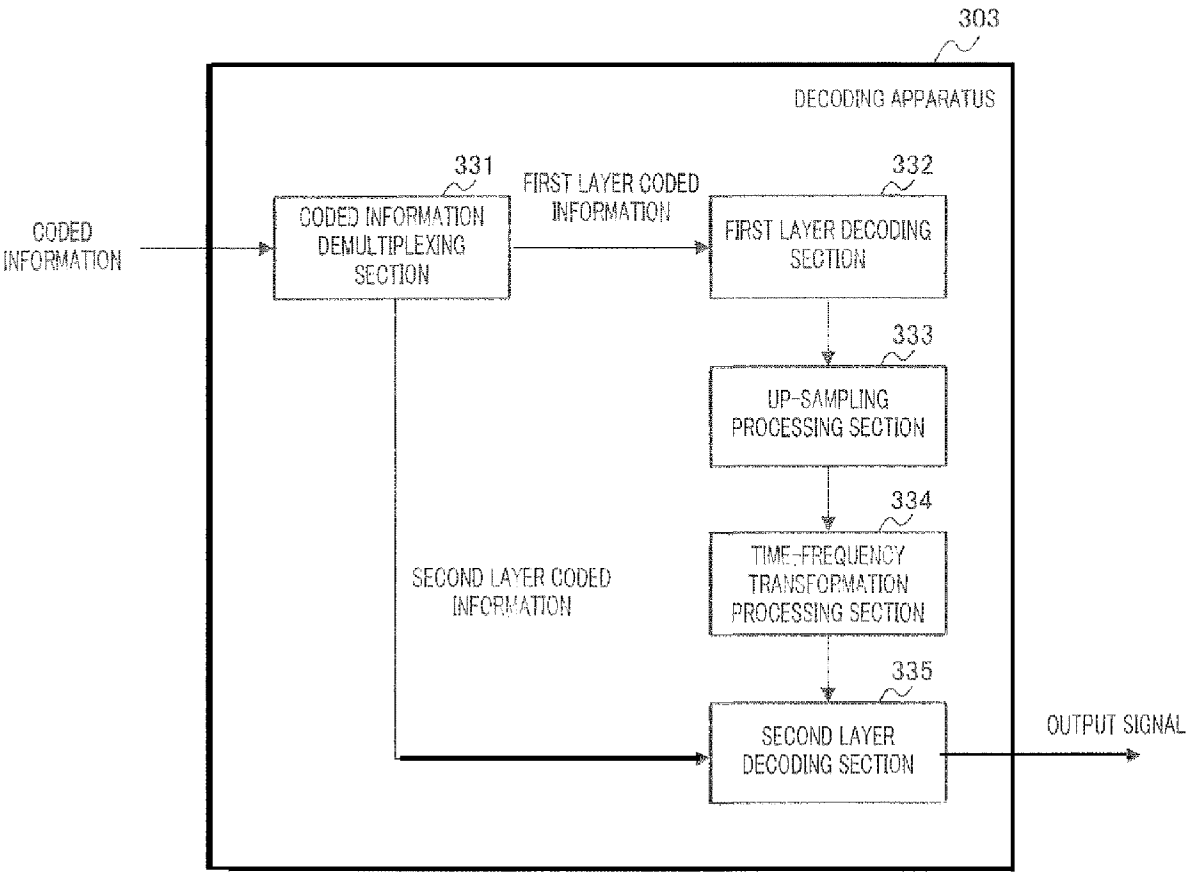
FIG. 11 is a block diagram showing an inner principal-part configuration of the decoding apparatus according to embodiment 2 shown in FIG. 5.

FIG. 11 is a block diagram showing an internal principal-part configuration of decoding apparatus 303.

In FIG. 11, coded information demultiplexing section 331 demultiplexs between first layer coded information and second layer coded information in coded information received as input, outputs the first layer coded information to first layer decoding section 332, and outputs the second layer coded information to second layer decoding section 335.

First layer decoding section 332 decodes the first layer coded information received as input from coded information demultiplexing section 331, and outputs the generated first layer decoded signal to up-sampling processing section 333. The operations of first layer decoding section 332 are the same as in first layer decoding section 313 shown in FIG. 6 and will not be explained in detail.

Up-sampling processing section 333 performs processing of up-sampling the sampling frequency from $SR_{base}$ to $SR_{input}$ with respect to the first layer decoded signal received as input from first layer decoding section 332, and outputs the resulting up-sampled first layer decoded signal to time-frequency transformation processing section 334.

Time-frequency transformation processing section 334 applies orthogonal transformation processing (MDCT) to the up-sampled first layer decoded signal received as input from up-sampling processing section 333, and outputs the MDCT coefficient S1($k$) (hereinafter "first layer decoded spectrum") of the resulting up-sampled first layer decoded signal to second layer decoding section 335. The operations of time-frequency transformation processing section 334 are the same as the processing in time-frequency transformation processing section 315 for an up-sampled first layer decoded signal shown in FIG. 6, and will not be described in detail.

Second layer decoding section 335 generates a second layer decoded signal including higher band components using first layer decoded spectrum S1($k$) received as input from time-frequency transformation processing section 334 and second layer coded information received as input from coded information demultiplexing section 331, and outputs this as an output signal.

Figure 12:
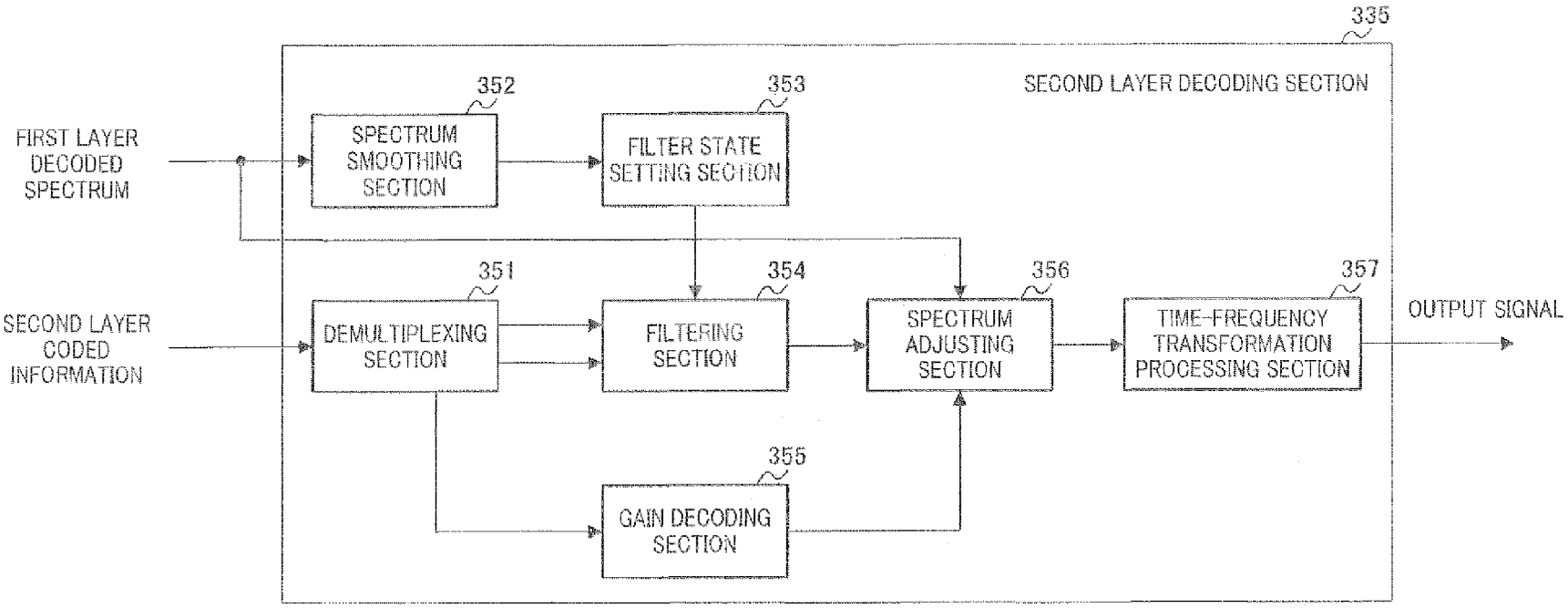
FIG. 12 is a block diagram showing an inner principal-part configuration of the second layer decoding section according to embodiment 2 shown in FIG. 11.

FIG. 12 is a block diagram showing an internal principal-part configuration of second layer decoding section 335 shown in FIG. 11.

Demultiplexing section 351 demultiplexes the second layer coded information received as input from coded information demultiplexing section 331 into band division information including bandwidth $BW_p$ (p=0, 1, . . . , P−1) and leading index $BS_P$ (p=0, 1, . . . , P−1) (FL<=$BS_p$<FH) of each subband, optimal pitch coefficient $T_p'$ (p=0, 1, . . . , P−1), which is information related to filtering, and the index of coded amount of variation $VQ_j$ (j=0, 1, . . . , J−1), which is information related to gain. Furthermore, demultiplexing section 351 outputs band division information and optimal pitch coefficient $T_p'$ (p=0, 1, . . . , P−1) to filtering section 354, and outputs the index of coded amount of variation $VQ_j$ (j=0, 1, . . . , J−1) to gain decoding section 355. If in coded information demultiplexing section 331 band division information $T_p'$ (p=0, 1, . . . , P−1) and $VQ_j$ (j=0, J−1) index are demultiplexed, demultiplexing section 351 is not necessary.

Spectrum smoothing section 352 applies smoothing processing to first layer decoded spectrum S1($k$) (0<=k<FL) received as input from time-frequency transformation processing section 334, and outputs smoothed first layer decoded spectrum S1'($k$) (0<=k<FL) to filter state setting section 353. The processing in spectrum smoothing section 352 is the same as the processing in spectrum smoothing section 361 in second layer coding section 316 and therefore will not be described here.

Filter state setting section 353 sets smoothed first layer decoded spectrum S1'($k$) (0<=k<FL) received as input from spectrum smoothing section 352 as the filter state to use in filtering section 354. Calling the spectrum of the entire 0<=k<FH frequency band "S(k)" in filtering section 354 for convenience, smoothed first layer decoded spectrum S1'($k$) is accommodated in the 0<=k<FL band of S(k) as the internal filter state (filter state). The configuration and operations of filter state setting section 353 are the same as filter state setting section 362 shown in FIG. 7 and will not be described in detail here.

Filtering section 354 has a multi-tap pitch filter (having at least two taps). Filtering section 354 filters smoothed first layer decoded spectrum S1'($k$) based on band division information received as input from demultiplexing section 351, the filter state set in filter state setting section 353, pitch coefficient $T_p'$ (p=0, 1, . . . , P−1) received as input from demultiplexing section 351, and a filter coefficient stored inside in advance, and calculates estimated spectrum S$2_p$'(k) ($BS_p$<=k<$BS_p$+$BW_p$) (p=0, 1, . . . , P−1) of each subband $SB_p$ (p=0, . . . , P−1) shown in equation 21 above. Filtering section 354 also uses the filter function represented by equation 20. The filtering processing and filter function in this case are represented as in equation 20 and equation 21 except that T is replaced by $T_p'$.

Gain decoding section 355 decodes the index of coded variation amount $VQ_j$ received as input from demultiplexing section 351, and finds amount of variation $VQ_j$ which is a quantized value of amount of variation $V_j$.

Spectrum adjusting section 356 finds estimated spectrum S2'($k$) of an input spectrum by connecting estimated spectrum S$2_p$'(k) ($BS_p$<=k<$BS_p$+$BW_p$) (p=0, 1, . . . , P−1) of each subband received as input from filtering section 354 in the frequency domain. According to equation 23 below, spectrum adjusting section 356 furthermore multiplies estimated spectrum S2'($k$) by amount of variation $VQ_j$ of each subband received as input from gain decoding section 355. By this means, spectrum adjusting section 356 adjust the spectral shape in the FL<=k<FH frequency band of estimated spectrum S2'($k$), generates decoded spectrum S3($k$) and outputs decoded spectrum S3($k$) to time-frequency transformation processing section 357.

[23]

$$S3(k)=S2'(k)\cdot VQ_j(BL_j\le k\le BH_j,\ \text{for all } j) \qquad \text{(Equation 23)}$$

Next, according to equation 24, spectrum adjusting section 356 substitutes first layer decoded spectrum S1($k$) (0<=k<FL), received as input from time-frequency transformation processing section 334, in the low band (0<=k<FL) of decoded spectrum S3($k$).

The lower band part (0<=k<FL) of decoded spectrum S3($k$) is formed with first layer decoded spectrum S1($k$) and the higher band part (FL<=k<FH) of decoded spectrum S3($k$) is formed with estimated spectrum S2'($k$) after the spectral shape adjustment.

[24]

$$S3(k)=S1(k)(0\le k\le FL) \qquad \text{(Equation 24)}$$

Time-frequency transformation processing section 357 performs orthogonal transformation of decoded spectrum S3($k$) received as input from spectrum adjusting section 356 into a time domain signal, and outputs the resulting second layer decoded signal as an output signal. Here, if necessary, adequate processing such as windowing or overlap addition is performed to prevent discontinuities from being produced between frames.

The processing in time-frequency transformation processing section 357 will be described in detail.

Time-frequency transformation processing section 357 has buffer buf'(k) inside and initializes buffer buf'(k) as shown with equation 25 below.

[25]

$$\text{buf}'(k)=0(k=0,\ldots,N-1) \qquad \text{(Equation 25)}$$

Furthermore, according to equation 26 below, time-frequency transformation processing section 357 finds second layer decoded signal $y_n''$ using second layer decoded spectrum S3($k$) received as input from spectrum adjusting section 356.

(Equation 26)

$$y_n'' = \frac{2}{N}\sum_{n=0}^{2N-1} Z4(k)\cos\left[\frac{(2n+1+N)(2k+1)\pi}{4N}\right] \quad [26]$$

$$(n = 0, \ldots, N-1)$$

In equation 26, Z4($k$) is a vector combining decoded spectrum S3($k$) and buffer buf'(k) as shown by equation 27 below.

(Equation 27)

$$Z4(k) = \begin{cases} buf'(k) & (k = 0, \ldots N-1) \\ S3(k) & (k = N, \ldots 2N-1) \end{cases} \quad [27]$$

Next, time-frequency transformation processing section 357 updates buffer buf'(k) according to equation 28 below.

[28]

$$buf'(k)=S3(k)(k=0, \ldots N-1) \quad \text{(Equation 28)}$$

Next, time-frequency transformation processing section 357 outputs decoded signal $y_n''$ as an output signal.

Thus, according to the present embodiment, in coding/decoding for performing bandwidth enhancement using a lower band spectrum and estimating a higher band spectrum, smoothing processing to combine an arithmetic mean and geometric mean is performed for a lower band spectrum as preparatory processing. By this means, it is possible to reduce the amount of calculation without causing quality degradation of a decoded signal.

Furthermore, although a configuration has been explained above with the present embodiment where, upon bandwidth enhancement coding, a lower band decoded spectrum obtained by means of decoding is subjected to smoothing processing and a higher band spectrum is estimated using a smoothed lower band decoded spectrum and coded, the present invention is by no means limited to this and is equally applicable to a configuration for performing smoothing processing for a lower band spectrum of an input signal, estimating a higher band spectrum from a smoothed input spectrum and then coding the higher band spectrum.

The spectrum smoothing apparatus and spectrum smoothing method according to the present invention are by no means limited to the above embodiments and can be implemented in various modifications. For example, embodiments may be combined in various ways.

The present invention is equally applicable to cases where a signal processing program is recorded or written in a computer-readable recording medium such as a CD and DVD and operated, and provides the same working effects and advantages as with the present embodiment.

Although example cases have been described above with the above embodiments where the present invention is implemented with hardware, the present invention can be implemented with software as well.

Furthermore, each function block employed in the above descriptions of embodiments may typically be implemented as an LSI constituted by an integrated circuit. These may be individual chips or partially or totally contained on a single chip. "LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells in an LSI can be regenerated is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosures of Japanese Patent Application No. 2008-205645, filed on Aug. 8, 2008, Japanese Patent Application No, 2009-096222, filed on Apr. 10, 2009, including the specifications, drawings and abstracts, are incorporated herein by reference in their entireties.

INDUSTRIAL APPLICABILITY

The spectrum smoothing apparatus, coding apparatus, decoding apparatus, communication terminal apparatus, base station apparatus and spectrum smoothing method according to the present invention make possible smoothing in the frequency domain by a small of amount and are therefore applicable to, for example, packet communication systems, mobile communication systems and so forth.

Explanation of Reference Numerals

| | |
|---|---|
| 100 | Spectrum smoothing apparatus |
| 101, 315, 334, 357 | Time-frequency transformation processing section |
| 102 | Subband dividing section |
| 103 | Representative value calculating section |
| 104 | Non-linear transformation section |
| 105 | Smoothing section |
| 106 | Inverse non-linear transformation section |
| 201 | Arithmetic mean calculating section |
| 202 | Geometric mean calculating section |
| 301 | Coding apparatus |
| 302 | Transmission channel |
| 303 | Decoding apparatus |
| 311 | Down-sampling processing section |
| 312 | First layer coding section |
| 313, 332 | First layer decoding section |
| 314, 333 | Up-sampling processing section |
| 316 | Second layer coding section |
| 317 | Coded information integrating section |
| 318 | Delay section |
| 331 | Coded information demultiplexing section |
| 335 | Second layer decoding section |
| 351 | Demultiplexing section |
| 352, 361 | Spectrum smoothing section |
| 353, 362 | Filter state setting section |
| 354, 363 | Filtering section |
| 355 | Gain coding section |
| 356 | Spectrum adjusting section |
| 360 | Band dividing section |
| 364 | Search section |
| 365 | Pitch coefficient setting section |
| 366 | Gain coding section |
| 367 | Multiplexing section |

The invention claimed is:

1. A spectrum smoothing apparatus comprising:

a time-frequency transformation section that performs a time-frequency transformation of an input signal and generates a frequency component;

a subband dividing section that divides the frequency component into a plurality of subbands;

a representative value calculating section that calculates, for each subband, a representative value by calculating an arithmetic mean and by using a multiplication calculation using the arithmetic mean;

a non-linear transformation section that performs a non-linear transformation of representative values of the subbands; and a smoothing section that smoothes the representative values subjected to the non-linear transformation in the frequency domain, wherein the representative value calculating section calculates the representative values of the subbands by dividing each subband into a plurality of subgroups, calculating an arithmetic mean value per subgroup, and calculating, for each subband, the geometric mean of the arithmetic mean values of the subgroups corresponding to the subband as the representative value of the subband.

2. The spectrum smoothing apparatus according to claim 1, further comprising an inverse non-linear transformation section that performs an inverse non-linear transformation of an opposite characteristic to the non-linear transformation, for the smoothed representative values.

3. The spectrum smoothing apparatus according to claim 1, wherein the non-linear transformation section performs the non-linear transformation having a characteristic of emphasizing a greater value, for the representative values.

4. The spectrum smoothing apparatus according to claim 1, wherein the non-linear transformation section performs a logarithmic transform as the non-linear transformation.

5. The spectrum smoothing apparatus according to claim 1, wherein the representative value calculating section calculates the representative values of the subbands by estimating a geometric mean using a result of the multiplication calculation.

6. A spectrum smoothing apparatus comprising:

a time-frequency transformation section that performs a time-frequency transformation of an input signal and generates a frequency component;

a subband dividing section that divides the frequency component into a plurality of subbands;

a representative value calculating section that calculates, for each subband, a representative value by calculating an arithmetic mean and by using a multiplication calculation using the arithmetic mean;

a non-linear transformation section that performs a non-linear transformation of representative values of the subbands; and a smoothing section that smoothes the representative values subjected to the non-linear transformation in the frequency domain, wherein:

the representative value calculating section calculates the representative values of each subband by dividing each subband into a plurality of subgroups, calculating an arithmetic mean value of each subgroup, and calculates, for each subband, a value obtained by multiplying arithmetic means values of subgroups corresponding to the subband as the representative value of the subband; and the non-linear transformation section calculates an intermediate value of each subband by performing the non-linear transformation of the representative value of each subband and calculates a value obtained by multiplying the intermediate in each subband by a reciprocal of a number of subgroups in each subband as a representative value subjected to the smoothing section.

7. A coding apparatus comprising:

a first coding section that generates first coded information by encoding a lower band part of an input signal at or below a predetermined frequency;

a decoding section that generates a decoded signal by decoding the first coded information; and a second coding section that generates second coded information by dividing a higher band part of the input signal above the predetermined frequency into a plurality of subbands and estimating the plurality of subbands from the input signal or the decoded signal, wherein the second coding section comprises a spectrum smoothing apparatus according to claim 1 that receives as input and smoothes the decoded signal, and estimates the plurality of subbands from the input signal or the smoothed decoded signal.

8. A decoding apparatus comprising:

a receiving section that receives first coded information and second coded information, the first coded information being obtained by encoding a lower band part of a coding side input signal at or below a predetermined frequency, and the second coded information being generated by dividing a higher band part of the coding side input signal above the predetermined frequency into a plurality of subbands and estimating the plurality of subbands from a first decoded signal obtained by decoding the coding side input signal or the first coded information;

a first decoding section that decodes the first coded information and generates a second decoded signal; and a second decoding section that generates a third decoded signal by estimating a higher band part of the coding side input signal using the second coded information, wherein the second decoding section comprises the spectrum smoothing apparatus of claim 1 that receives as input and smoothes the second decoded signal and estimates the higher band part of the coding side input signal from the smoothed second decoded signal.

9. A communication terminal apparatus comprising the spectrum smoothing apparatus of claim 1.

10. A base station apparatus comprising the spectrum smoothing apparatus of claim 1.

11. A communication terminal apparatus comprising the spectrum smoothing apparatus of claim 6.

12. A base station apparatus comprising the spectrum smoothing apparatus of claim 6.

* * * * *